US008196364B2

(12) United States Patent
Moscovitch

(10) Patent No.: US 8,196,364 B2
(45) Date of Patent: Jun. 12, 2012

(54) DRYWALL APPARATUS AND METHOD

(76) Inventor: Jerry Moscovitch, Toronto (CA)

( * ) Notice: Subject to any disclaimer, the term of this patent is extended or adjusted under 35 U.S.C. 154(b) by 891 days.

(21) Appl. No.: 12/045,526

(22) Filed: Mar. 10, 2008

(65) Prior Publication Data

US 2008/0216425 A1 Sep. 11, 2008

Related U.S. Application Data

(60) Provisional application No. 60/894,061, filed on Mar. 9, 2007.

(51) Int. Cl.
*E04H 1/00* (2006.01)

(52) U.S. Cl. ..... 52/238.1; 52/287.1

(58) Field of Classification Search ..... 52/287.1, 52/238.1, 288.1, 254; 428/124
See application file for complete search history.

(56) References Cited

U.S. PATENT DOCUMENTS

| | | | | |
|---|---|---|---|---|
| 3,440,790 | A * | 4/1969 | Nerem | 52/631 |
| 3,900,550 | A * | 8/1975 | Oliver et al. | 264/320 |
| 6,332,296 | B1 * | 12/2001 | Moscovitch | 52/287.1 |
| 6,446,399 | B1 * | 9/2002 | Lecours | 52/81.2 |
| 6,758,017 | B2 * | 7/2004 | Young | 52/255 |
| 7,485,358 | B2 * | 2/2009 | Benaets | 428/124 |

* cited by examiner

*Primary Examiner* — Basil Katcheves

(57) ABSTRACT

Described herein is a drywall apparatus for constructing planar partitions and corners. The drywall apparatus includes a first drywall panel, a second drywall panel and a pliable hinge connecting the first drywall panel to the second drywall panel. The hinge allows the first drywall panel and the second drywall panel to assume a range of angles therebetween to thereby enable the apparatus to be used for constructing planar partitions and corners. A flap extending from an edge of the drywall panel can also be included. The flap is designed to overlap a surface of an adjacent drywall panel abutted against the edge of the drywall panel and designed to affix the panel to a stud or other supporting member.

12 Claims, 11 Drawing Sheets

DRYWALL APPARATUS AND METHOD

CROSS-REFERENCE TO RELATED APPLICATIONS

This application claims priority from U.S. Provisional Application No. 60/894,061, filed on Mar. 9, 2007.

FIELD OF THE INVENTION

This invention relates to a drywall apparatus and method.

BACKGROUND OF THE INVENTION

In the construction of buildings it is now common to use drywall or wallboard (hereinafter simply referred to as "drywall") on the interior of the structure to finish interior walls of the structure. For a length of wall that is larger than the width of a single sheet of drywall, more than one sheet of drywall has to be used to span the length of the wall. Seams arise where two sheets of drywall are abutted against each other. Seams also arise at corners of walls where two sheets of drywall are abutted at right angles to form a corner. Much of the difficulty in using drywall is associated with the proper treatment of seams. The edges of drywall sheets are tapered so that when two drywall sections are positioned adjacent one another a "cove" or depression is formed. The cove must first be filled with mud and then drywall tape is pressed into the mud along the full length of the cove. More mud is then placed over the tape before the first sanding of the resulting joint is performed. The mudding and sanding process is often performed several times before the seams take on the appearance of a clean, integrally formed area with no visually perceptible joint areas. Thus, the treatment of seams adds to the overall cost of constructing any structure where drywall is used and increases the time needed for drywall finishing.

When forming outer corners between two drywall sections, it has previously been necessary to nail or screw a metal corner section, sometimes referred to as a corner bead, over the corner before taping and mudding the corner. The metal corner member has to be attached carefully such that it forms a straight vertical edge. If this component is not attached properly, a "wavy", non-linear edge will be formed, requiring even further finishing efforts.

The above finishing process can be particularly troublesome for home remodeling applications undertaken by "do-it-yourself" persons. By this term, it is meant those individuals who do not have extensive experience in working with drywall finishing and have not acquired the necessary skill to finish drywall seams to produce clean, well-finished wall and corner areas free from visual imperfections.

It will be appreciated that there is a need for an apparatus and method that allows the installation of drywall to proceed more quickly and easily than the traditional approach.

SUMMARY

Described herein is a drywall apparatus and method for constructing planar partitions and corners. The apparatus includes a first drywall panel and a second drywall panel. A pliable hinge connects the first drywall panel to the second drywall panel. The hinge allows the first drywall panel and the second drywall panel to assume a range of angles therebetween to thereby enable the apparatus to be used for constructing planar partitions and corners.

One or more flaps can extend from the panels. For example, in one embodiment a first flap extends from an edge of the first drywall panel and a second flap extending from an opposite edge of the second drywall panel. The first flap is designed to overlap a first adjacent drywall panel abutted against one end of the drywall panel and the second flap is designed to overlap a second adjacent drywall panel abutted against an opposite end of the drywall panel during a construction process.

DESCRIPTION OF THE INVENTION

Figure 1:
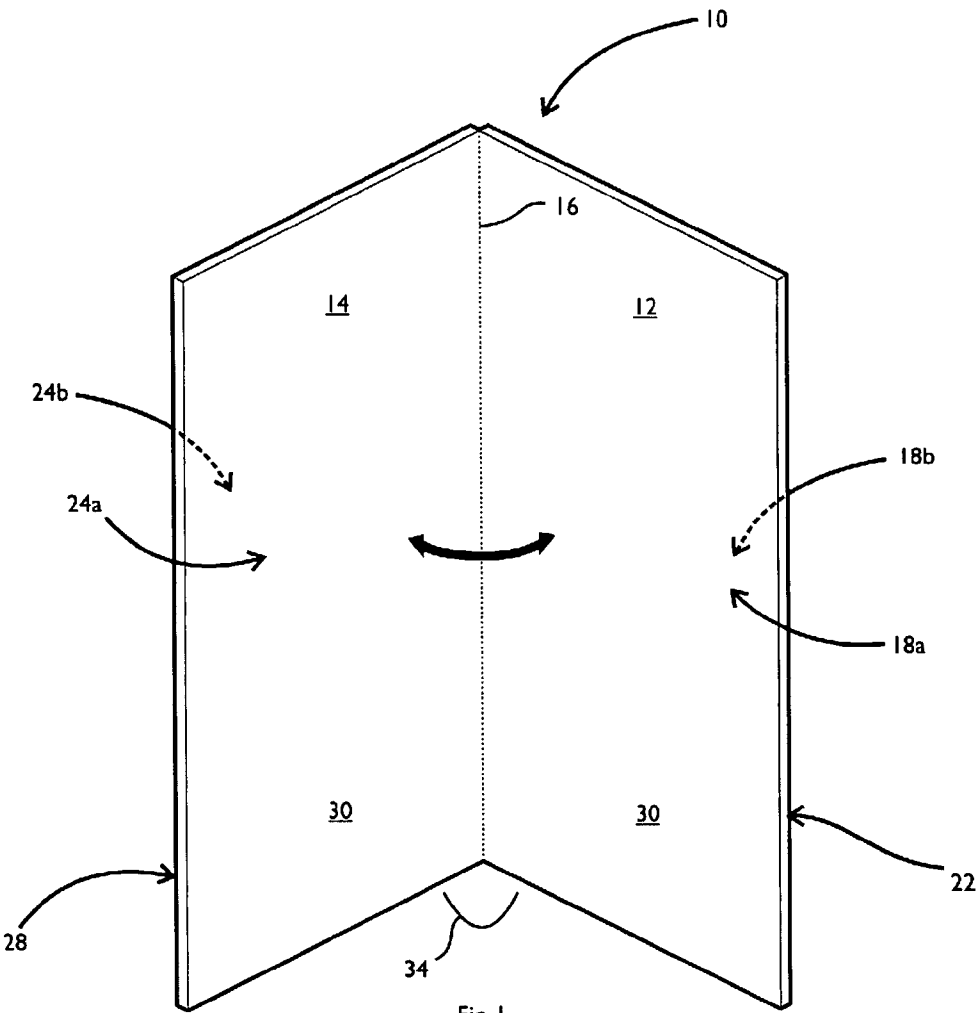
FIG. 1 shows a perspective view of a drywall apparatus for constructing planar partitions and corners, according to the principles of the present invention.

FIG. 1 shows a drywall apparatus 10 for constructing planar partitions and corners. Planar partitions refer to barriers that form walls and ceilings. The drywall apparatus 10 includes a first drywall panel 12, a second drywall panel 14, and a pliable hinge 16 connecting the first drywall panel 12 to the second drywall panel 14.

The hinge 16 allows the first drywall panel 12 and the second drywall panel 14 to assume a range of angles therebetween to thereby enable the apparatus to be used for constructing planar partitions and corners.

The first drywall panel 12 has a front surface 18*a* and a back (or rear) surface 18*b*. The front surface 18*a* and the back surface 18*b* can include tapering edge surfaces adjacent a distal end 22 of the first drywall panel 12, as described below with reference to FIGS. 4, 5 and 7. Likewise, the second drywall panel 14 has a front surface 24*a* and a back surface 24*b* that can also include tapering edge surfaces adjacent a distal end 28 of the second drywall panel 14. The tapering edge surfaces can facilitate blending of the distal ends with adjacently positioned drywall sections positioned abuttingly against each of the distal ends when mudding during a construction process.

The hinge can take a number of forms. For example, in the embodiment shown in FIG. 1, the first drywall panel 12 and the second drywall panel 14 have respective front surfaces 18*a* and 24*a* laminated with drywall paper 30. The hinge 16 is formed from the drywall paper 30. The drywall paper 30 covering both front surfaces 18*a* and 24*a* can be integral. The hinge 16 can be formed by folding the drywall paper 30 to form a crease 32. The hinge 16 shown in FIG. 1 allows the front surfaces 18*a* and 24*a* to assume an angle 34 ranging from zero degrees to 180 degrees.

Figure 2:
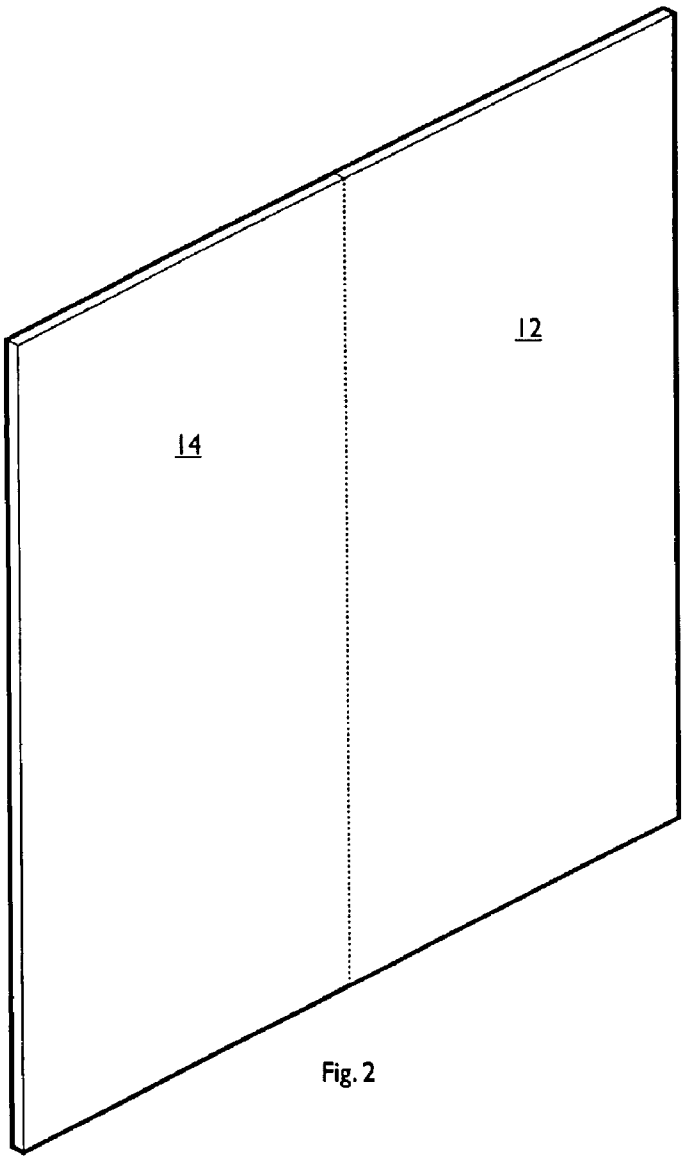
FIG. 2 shows a perspective view of the drywall apparatus of FIG. 1 such that the angle between the first and second panels is 180 degrees.

The same drywall apparatus 10 can be used to construct planar barriers, such as walls or ceilings. In such case, the drywall panels 12 and 14 would lay flat, i.e., the angle 34 between the first and second panels would be 180 degrees, such as shown in FIG. 2. Two other similar drywall apparatuses (not shown) could then be abutted against either end 13, 15 of the apparatus 10 to span a wall having six drywall panels. More or fewer drywall apparatuses 10 could be used as needed.

Aside from helping form corners, the hinge 16 facilitates packaging and shipping of the drywall apparatus 10 since the panels 12, 14 can be folded over (i.e., the angle 34 is zero) to make the dimensions more manageable for packaging and shipping.

Figure 3:
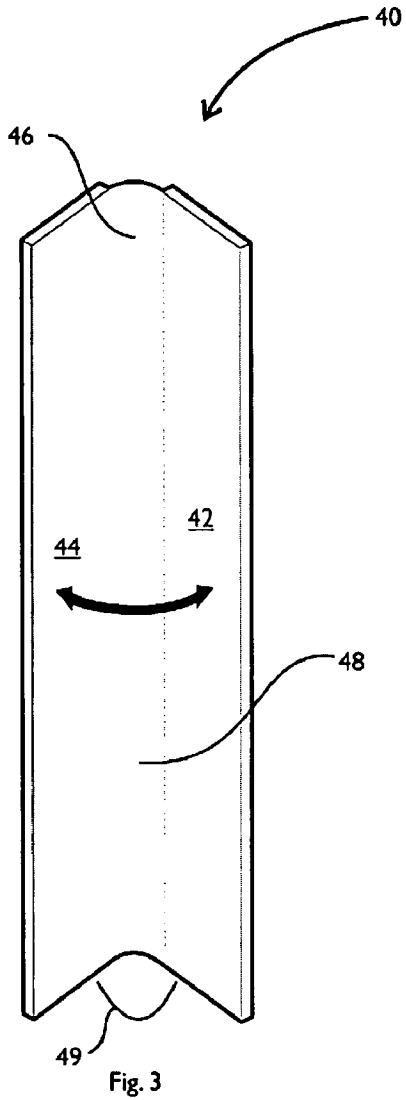
FIG. 3 shows a perspective view of another embodiment of a drywall apparatus for constructing planar partitions and corners, according to the principles of the present invention.

The hinge connecting the first and second drywall panels can take other forms in other embodiments. For example, FIG. 3 shows another embodiment of a drywall apparatus 40 for constructing planar partitions and corners. The drywall apparatus 40 includes a first drywall panel 42, a second drywall panel 44, and a pliable hinge 46 connecting the first drywall panel 42 to the second drywall panel 44.

The hinge 46 allows the first drywall panel 42 and the second drywall panel 44 to assume a range of angles therebetween to thereby enable the apparatus to be used for constructing planar partitions and corners. The hinge 46 includes an elongated, thin length of plastic 48 formed between the first drywall panel 42 and the second drywall panel 44. The drywall panels 42, 44 and the plastic connecting section 48 also have drywall paper laminated thereon. The length of plastic connecting section 48 is flexible such that either a rounded inner corner or a rounded outer corner can be formed.

The desired radius of curvature can be obtained by manufacturing drywall apparatus 40 having varying lengths of plastic portions 48 as needed to enable corner portions to be formed having a precise radius of curvature. For example, manufacturing the drywall apparatus 40 with a connecting section 48 having a length of 1 inch could allow a corner to be formed having a 0.5 inch radius of curvature, whereas a length of 2 inches could enable a 1.0 inch radius of curvature corner to be formed. Thus, any desired radius of curvature could be accommodated by providing either a longer or shorter plastic connecting section 48. Depending upon the thickness of the connecting section 48 and the material the apparatus is constructed from, the radius of curvature could also be adjusted simply by moving the drywall panels 42 and 44 towards or away from the corner.

The drywall panels 42, 44 and the thin plastic connecting section 48 are preferably extruded from high strength plastic such as polypropylene to form a single component which can be laid flat for shipping purposes. Alternatively, the plastic connecting section 48 can be manufactured to allow the first drywall panel 42 and the second drywall panel 44 to be stacked for shipping purposes. In such case, the angle between the drywall panels is zero degrees, and the connecting section 48 would assume a "U" shape. If desired, the connection section 48 and the drywall panels 42, 44 could be co-extruded from different materials to either reduce material cost or weight.

Figure 4:
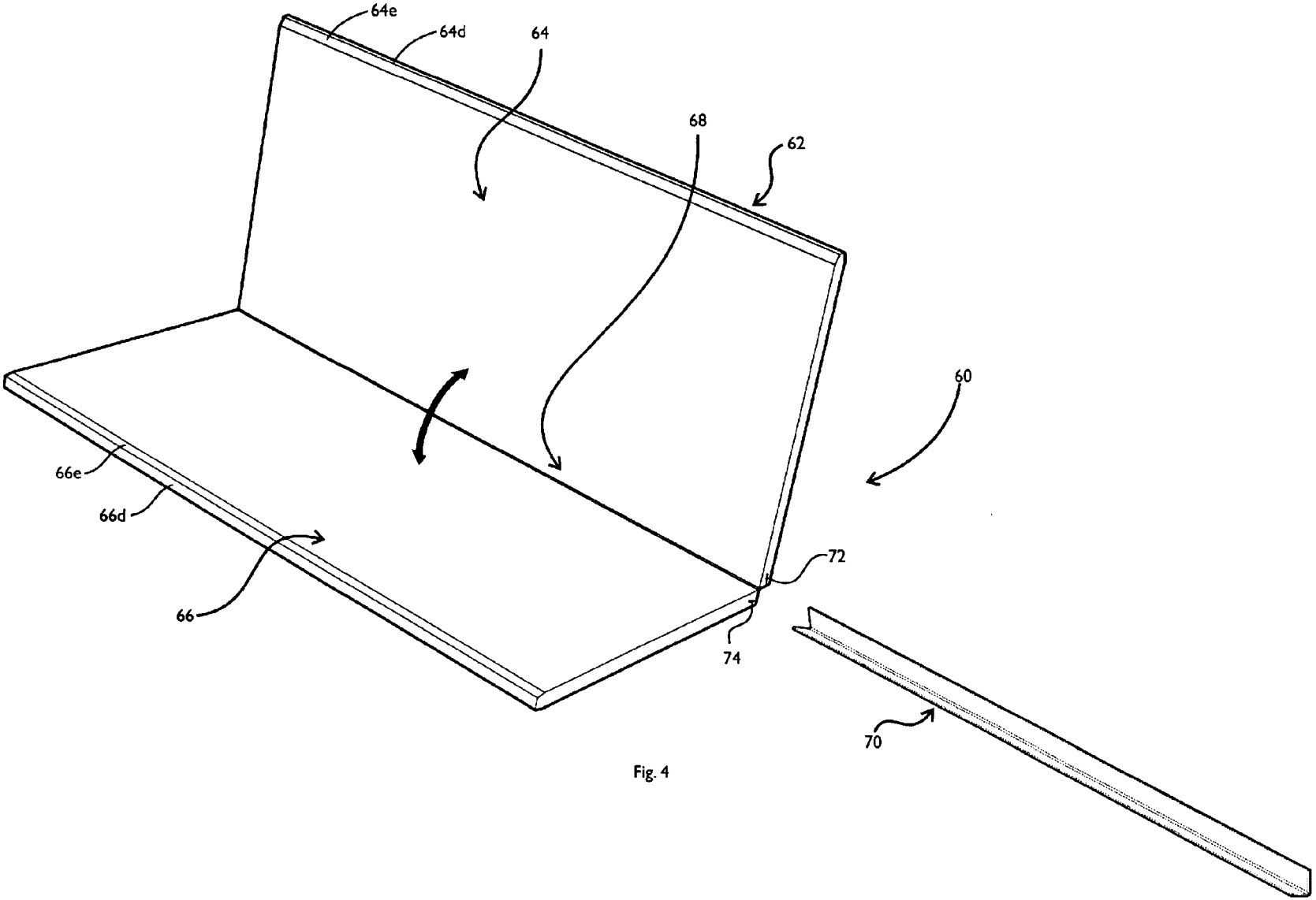
FIG. 4 shows a perspective view of another embodiment of a drywall apparatus that can be used for an inner corner, an outer corner, a ceiling or a wall, according to the principles of the present invention.

FIG. 4 shows a drywall apparatus 60 that is a variant of the embodiments shown in FIGS. 1-3, and which can be used for an inner corner, an outer corner, a ceiling or a wall. The drywall apparatus 60 includes a first drywall panel 64, a second drywall panel 66, and a pliable hinge 68 connecting the first drywall panel 64 to the second drywall panel 66.

The hinge 68 allows the first drywall panel 64 and the second drywall panel 66 to assume a range of angles therebetween to thereby enable the apparatus 60 to be used for constructing planar partitions and corners.

Figure 5:
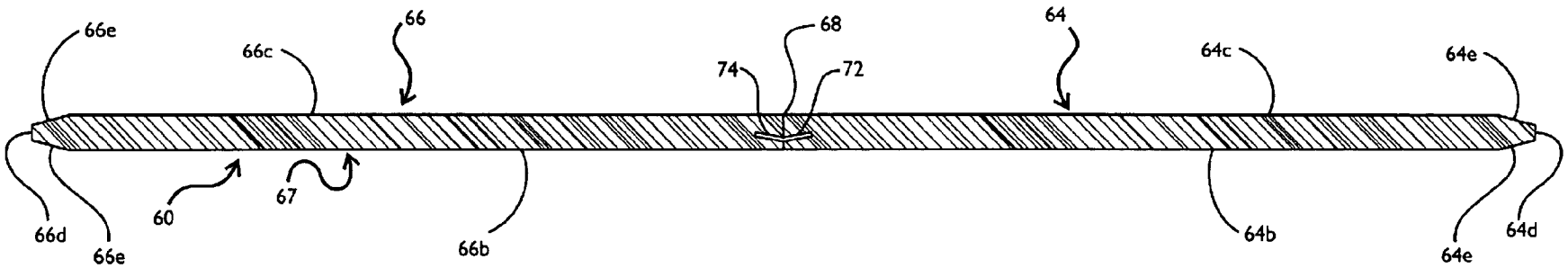
FIG. 5 shows a cross-sectional view of the drywall apparatus of FIG. 4 such that the first and second drywall panels lie flat.

Referring further to FIGS. 4 and 5, the first drywall panel 64 includes a groove 72 near the hinge 68, where the groove 72 extends along the entire length of the first drywall panel 64 substantially parallel to the hinge. Similarly, the second drywall panel 66 includes a groove 74 near the hinge 68 where the groove 74 extends along the entire length of the second drywall panel 66.

The first drywall panel 64 further includes a front surface 64*b* and a rear (or back) surface 64*c*. The second drywall panel 66 similarly includes a front surface 66*b* and a rear (or back) surface 66*c*. A distal end 64*d* of the first drywall panel 64 includes tapered areas 64*e* forming "coves" or depressions to help in blending the first drywall panel 64 in with an adjacently positioned portion of drywall. Similarly, the second drywall panel 66 includes a distal end portion 66*d* having tapered portions 66*e* which form coves to help in blending in the distal end portion 66*d* with an adjacently positioned section of drywall when taping and mudding the joint between these panels. Each of the front and rear surfaces 64*b*, 64*c* and 66*b*, 66*c* of each panel portion further has drywall paper 67 laminated thereon. The hinge 68 can be formed by creasing this laminated paper where the first and second panels 64,66 join.

Figures 6, 7:
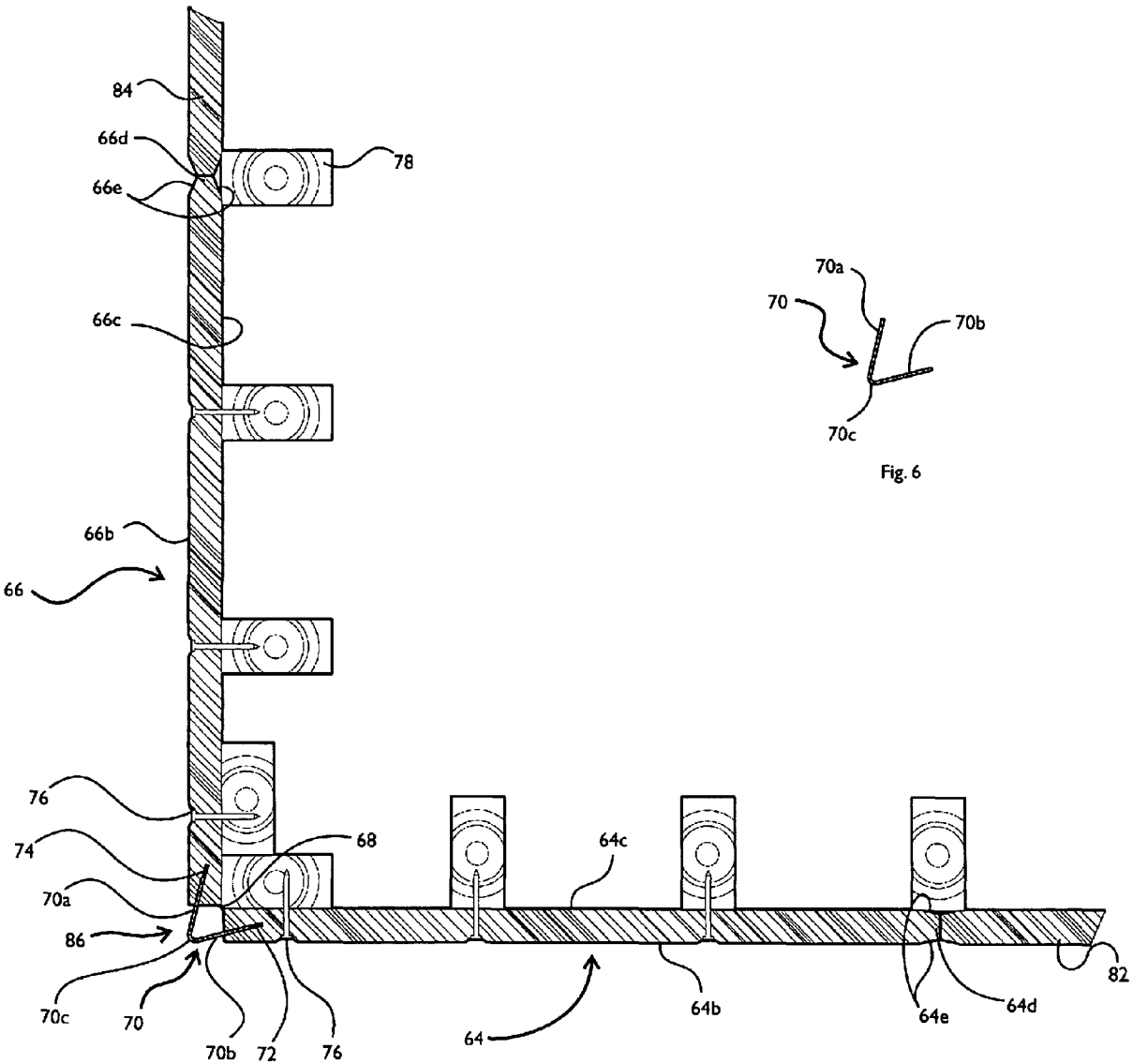
FIG. 6 shows a cross sectional view of a corner member, used in conjunction with the apparatus shown in FIG. 5.
FIG. 7 shows a cross-sectional view of the apparatus of FIG. 5 and the corner member of FIG. 6.

As shown in FIG. 6, a corner member 70, which can be constructed using steel or other sufficiently stiff material, includes arm portions 70*a* and 70*b* and a corner edge portion 70*c*. Arm portions 70*a* and 70*b* are adapted to be slid into the grooves 72 and 74 from one end of the drywall panels 64, 66 when the apparatus 10 is being used to form an outer corner of a wall. Thus, the corner member 70 does not need to be secured with drywall screws or nails to any adjacent section of drywall.

Referring now to FIG. 7, the corner member 70 is illustrated attached to the drywall panels 64 and 66. Each of the drywall panels 64 and 66 is further secured either by nails or threaded drywall screws 76 to wooden studs 78 at the corner area of a wall structure 80 formed by the studs. The corner edge 70*c* provides an extremely straight edge, which is used with conventional taping and mudding techniques to provide a corner for the wall area. The material from which the drywall panels are constructed also preferably allows a slight degree of deformation to be produced around the head of each nail or drywall screw 76 when the nail or screw is driven through its associated drywall panel 64 or 66 tightly into a supporting wood stud 78. This allows the head to be driven down into the drywall panels 64 or 66 slightly such that the head is slightly below the outer surface of the panel 64 or 66. This enables these areas to be patched easily during the finishing process. Polypropylene allows for this slight degree of deformation.

With further reference to FIG. 7, in use, the metal corner member 70 is inserted into the grooves 72, 74, which holds the drywall panels 64, 66 at the desired angular orientation. The drywall panels 64 and 66 are then secured to the studs 78 and additional drywall panels 82, 84 are abutted up against the distal ends 64*d*, 66*d* of the panels 64, 66. Taping and mudding is then performed to finish the outer corner area 86 and the joints between the drywall panels 82, 84 and the distal ends 64*d*, 66*d* of the panels 64, 66.

When not used for an outside corner, the same drywall apparatus 60 can be used for forming an inner corner, a planar partition in a wall, or a planar partition in a ceiling area. In such case, the metal corner member 70 would not be used. The first and second drywall panels 64 and 66 would be configured to lie flat, as shown in FIG. 5, so that the angle there between is substantially 180 degrees. The resultant planar structure could then be used to form walls or ceilings by abutting other drywall panels against the ends 64*d* and 66*d*.

It will be appreciated that the drywall apparatus 60 can be extruded in different lengths to meet the needs of specific applications. The drywall panels 64, 66 and the hinge 68 could be co-extruded from different materials if desired to lower material costs or weight. It is anticipated that in most instances the drywall apparatus, together with the metal corner member 70, will be cut to lengths of 8 feet, 10 feet or 12 feet, which are most commonly used in the construction industry. The width of the first drywall panel 64, i.e., the distance from the hinge 68 to the distal end 64*d*, can be 4 feet. Likewise, the width of the second drywall panel 66, i.e., the distance from the hinge 68 to the distal end 66*d*, can also be 4 feet. The thickness of each drywall panel 64, 66 is selected to match that of the drywall being used. In most instances this will be 0.375 inches, 0.5 inches or 0.625 inches, which are the thicknesses of drywall most commonly used. It should be understood that the drywall panels can be manufactured to have other dimensions, as desired.

Preformed openings could also be included for the drywall screws or nails 76 at points along the length of each panel portion 64 and 66 if desired. The metal corner member 70 may be made from other suitably strong materials, which can be formed in a generally L-shaped configuration, or in any other desired angular configuration.

In the embodiments of FIGS. 4, 5 and 7, the front sides 64*b*, 66*b* and/or the back sides 64*c*, 66*c* can be designed to be exposed sides, which can be painted, wallpapered, plastered, etc. For example, only the back sides might have drywall paper if the drywall apparatus is only to be used for inside corners. When used for an inside corner, the corner member 70 would not normally be used, unless the drywall apparatus is being used simultaneously as an inside and outside corner. In a preferred embodiment, the front sides 64*b*, 66*b* and the back sides 64*c*, 66*c* are designed to be exposed sides to allow the user the option to use the same apparatus for both inside and outside corners, as well as walls and other partitions.

Figure 8:
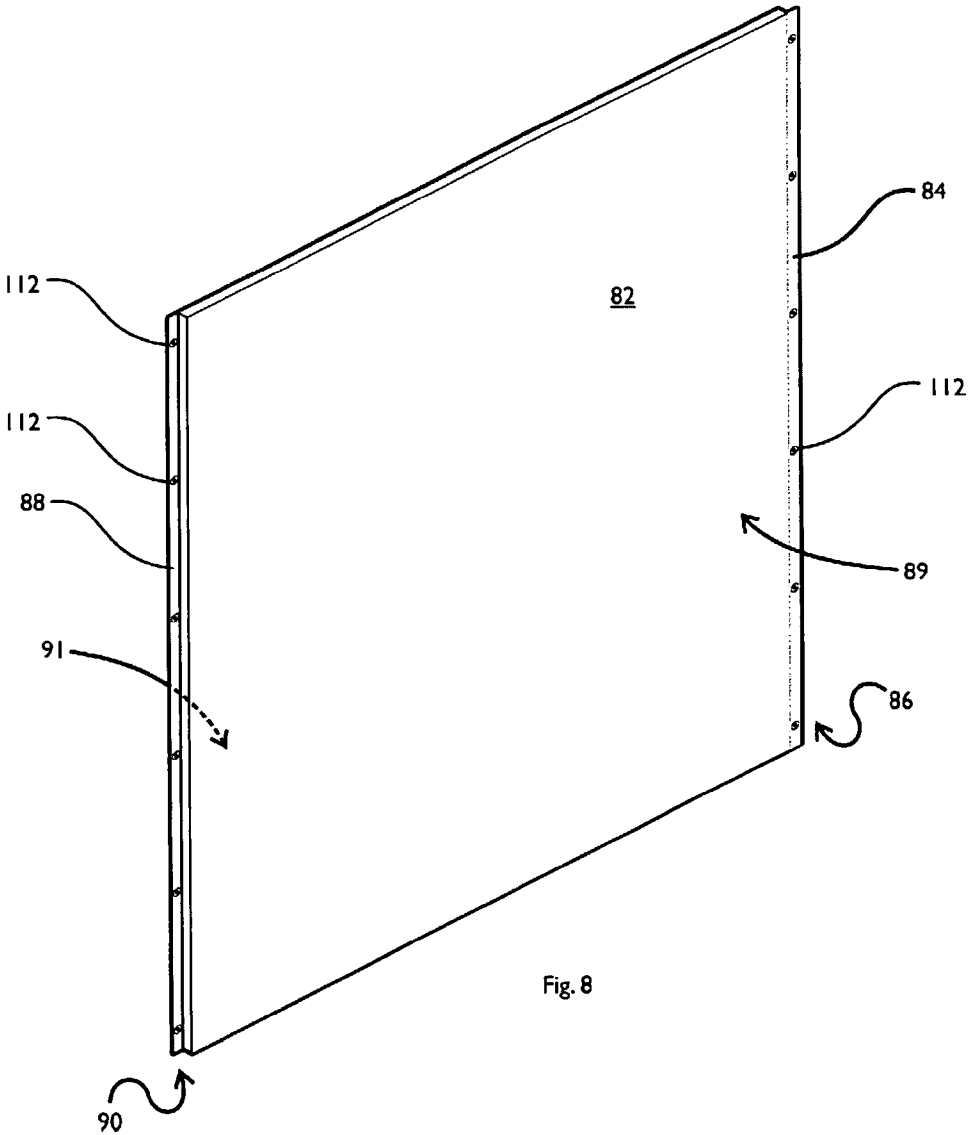
FIG. 8 shows a perspective view of another embodiment of a drywall apparatus, according to the principles of the present invention.

FIG. 8 shows a drywall apparatus 80 according to the principles of the present invention. The drywall apparatus 80 includes a drywall panel 82. The drywall panel 82 has a first flap 84 extending from an edge 86 of the drywall panel 82. The drywall panel 82 also has a second flap 88 extending from an opposite edge 90 of the drywall panel 82. The first flap 84 is on a front surface 89 of the drywall panel 82, and the second flap 88 is on a back surface 91 of the drywall panel 82.

Figure 9:
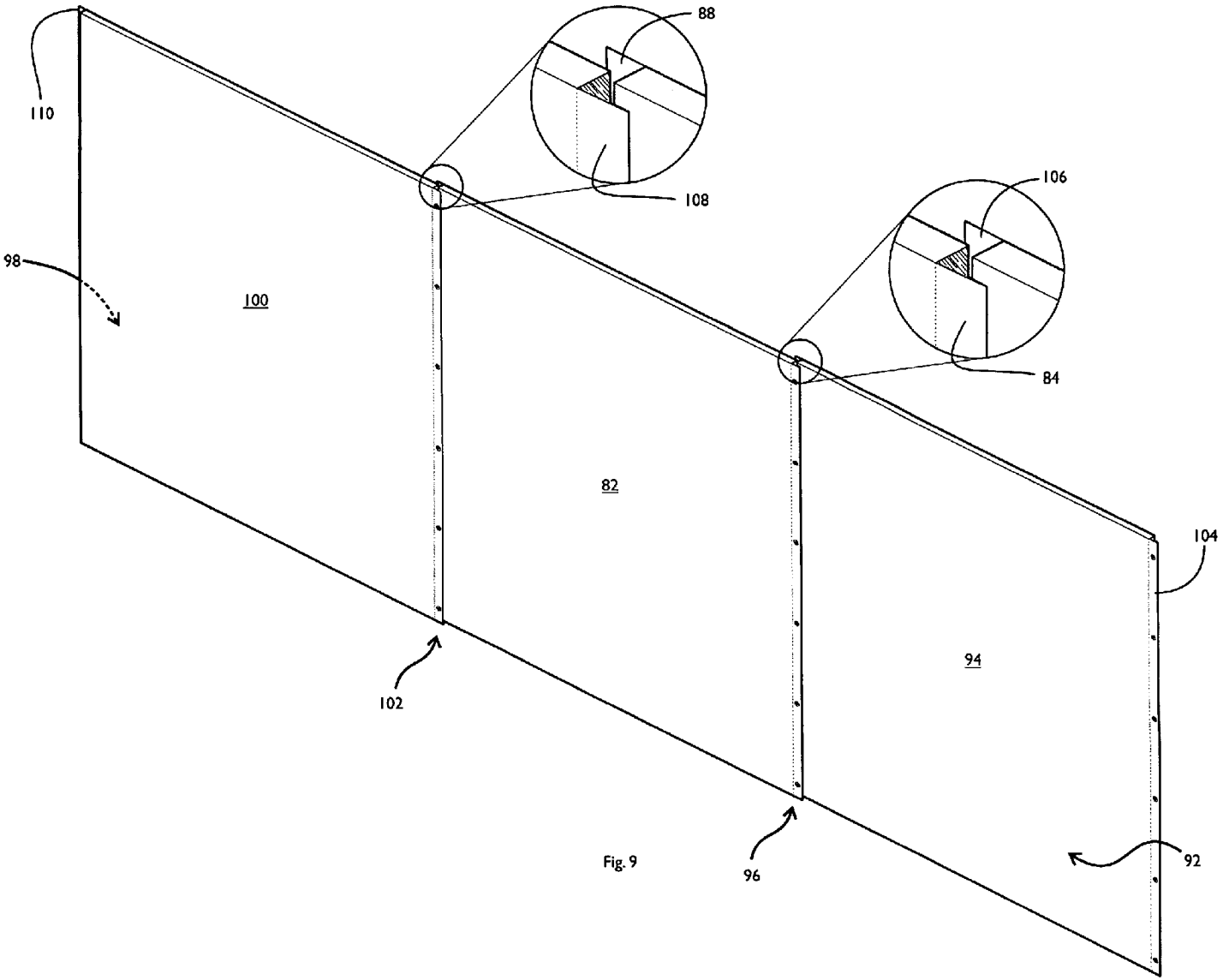
FIG. 9 shows a perspective view of three drywall apparatuses of FIG. 4 illustrating how they can be assembled.

Referring to FIG. 9, the first flap 84 is designed to overlap a front surface 92 of a first adjacent drywall panel 94 abutted against one end 96 of the drywall panel 82 and the second flap 88 is designed to overlap a back surface 98 of a second adjacent drywall panel 100 abutted against an opposite end 102 of the drywall panel 82. For clarity, the panels shown in FIG. 9 do not completely abut one another, but it should be understood that when building partitions, the ends of the panels are to be abutted against each other. The first adjacent drywall panel 94 is similar to the drywall panel 82, and also contains flaps 104 and 106. Likewise, the second drywall panel 100 also contains flaps 108 and 110. Thus, at seams where two panels abut, one flap is on the front of one panel, and the other flap is on the back of the other panel. Less preferably, at a seam, the flap of one panel and the flap of the other panel would both be on the same side.

The first flap 84 and the second flap 88 can each have holes 112 to allows drywall nails or screws to be inserted therein for affixing the panel 82 to studs for forming an indoor partition, such as a wall or ceiling. Instead, or in addition, to having holes 112, the flap could incorporate other fastening means, such as an adhesive strip for example, to affix the drywall apparatus to a stud or other supporting member.

In the embodiment shown in FIG. 8, the first flap 84 extends from an edge 86 of the front surface 89 of the drywall panel 82, and the second flap 88 extends from an opposite edge of the back surface 91 of the drywall panel 82. The other two permutations would involve placing both flaps on the back, or placing both flaps on the front. The advantage of having one flap on the front and the other on the back is that, in the case where the front surface of the drywall panel is finished, but not the back surface, all drywall panels can be manufactured identically, and subsequently abutted as in FIG. 9. (If the back and front sides are finished, the drywall panel 82, the first adjacent drywall panel 94 and the second adjacent drywall panel 100 can be identical.) If, on the other hand, both flaps are placed on the front, and if abutting panels are to have flaps on opposite sides, then two different types of panels have to be manufactured: one where the flaps are on the front and one where the flaps are on the back.

In another embodiment, each panel would only have one flap, instead of two. The one flap could extend from the front surface. When abutting two panels together, the edge having a flap of one panel could be abutted to the edge having no flap of the other panel. Instead or in addition to having one or more flaps on a side edge of each panel, as shown in FIG. 8-11, the one or more flaps can be disposed on top and/or bottom edges of the panels.

The flaps can be extensions, preferably smooth, integral extensions, of drywall or laminated paper present on the surface of the drywall panel. Alternatively, the flaps can be strips of material affixed to the panels by any appropriate means, such as adhesive or staples.

Advantageously, by adding one or two flaps to a drywall panel, the need to add drywall tape at a seam is obviated. Instead, some drywall mud could be applied along the outer edge of the flap to hide any seam that might otherwise be visible.

Preferably, the drywall apparatus is constructed such that a flap is disposed at each seam on the side of the panel that is designed to be an exposed side. The exposed side can be painted, plastered, etc. as desired. Instead, or in addition, the flap can be on the side on the drywall apparatus that is not designed to be exposed. In such case, the flap could help to affix the apparatus to a stud, or other supporting member, using nails that are inserted through the holes 112.

Figure 10:
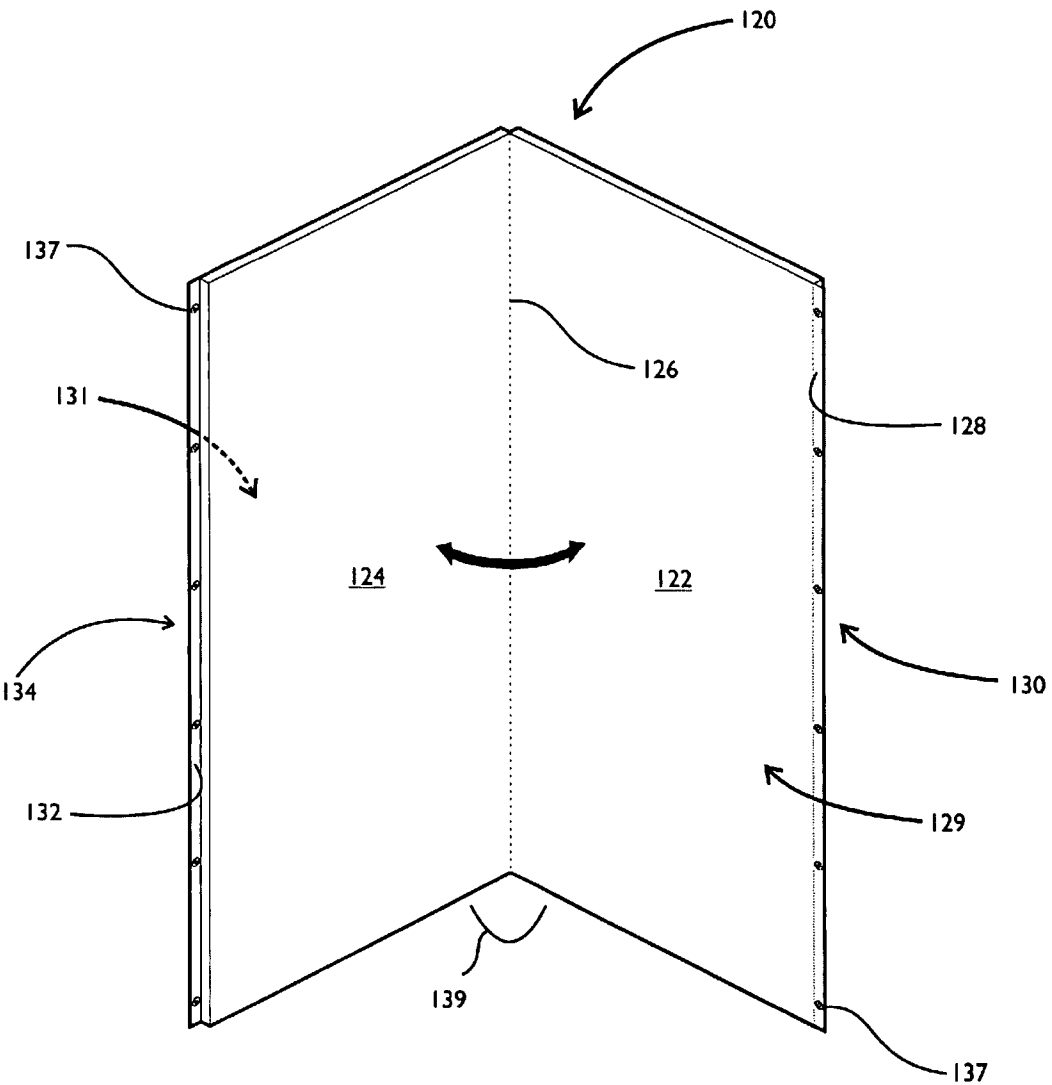
FIG. 10 shows a perspective view of the drywall apparatus of FIG. 4 such that drywall panels are angled.

FIG. 10 shows a drywall apparatus 120 that combines the advantage of a hinge and flaps for constructing planar partitions and corners. The drywall apparatus 120 includes a first drywall panel 122, a second drywall panel 124, and a pliable hinge 126 connecting the first drywall panel 122 to the second drywall panel 124.

The hinge 126 allows the first drywall panel 122 and the second drywall panel 124 to assume a range of angles therebetween to thereby enable the apparatus to be used for constructing planar partitions and corners, as described above.

The first drywall panel 122 has a first flap 128 extending from an edge 130 of the first drywall panel 122. The second drywall panel 124 also has a second flap 132 extending from an opposite edge 134 of the second drywall panel 124. The first flap 128 is on the front surface 129 of the first drywall panel 122, and the second flap 132 is on the back surface 131 of the second drywall panel 124. The flaps 128 and 132 are used as described above to obviate the need to use drywall tape along drywall seems. The pliable hinge 126 allows the apparatus 120 to be used for planar partitions (walls and ceilings), where the angle formed between the two panels 122 and 124 is substantially 180 degrees, and for corners, where the angle is not 180 degrees, but rather, in typical situations, equal to 90 degrees. In addition, the flaps have holes 137 that can be used to insert drywall nails or screws that can be used to affix the drywall apparatus to adjacent an adjacent drywall apparatus and/or wood studs. The pliable hinge also allows the two panels 122 and 124 to be folded together for easier transportation.

Figure 11:
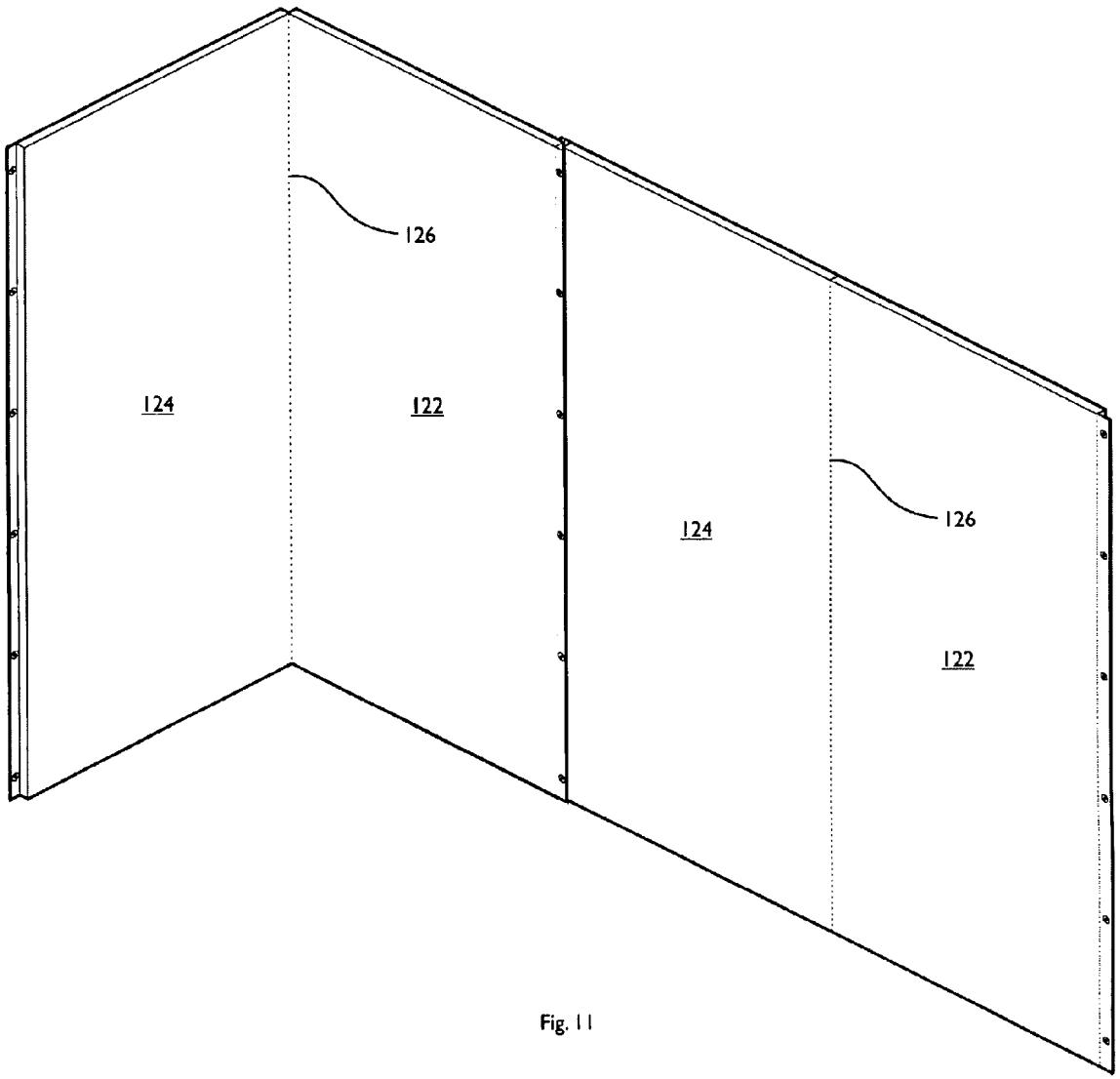
FIG. 11 shows a perspective view of two drywall apparatuses of FIG. 4 illustrating how they can be assembled.

The presence of flaps 128, 132 and the pliable hinge 126 obviates the need to use drywall tape, and reduces the amount of drywall mud needed for the construction of walls, ceilings and corners The drywall apparatus described herein can be used for constructing planar partitions and corners. In a first step, a first drywall apparatus is provided having a first pair of drywall panels connected together by a pliable hinge. For forming a corner in a corner region, the first drywall apparatus is placed in the corner region so that the angle 139 between the front faces of the first pair of drywall panels is different from 180 degrees. For a typical corner, the angle would be 90 degrees, but other angles are possible due to the pliability of the hinge. Next, a second drywall apparatus is provided having a second pair of drywall panels connected together by a pliable hinge. For forming a planar partition in a wall or ceiling region, the second drywall apparatus is abutted against the first drywall apparatus and placed in the wall or ceiling region so that the angle between the front faces of the second pair of drywall panels is substantially equal to 180 degrees. The result, where the second drywall apparatus is used in a wall region, is shown in FIG. 11.

In other embodiments, the drywall apparatus can have fewer or more flaps than the number shown in FIG. 10, and can also be disposed in other locations. For example, instead of the flaps being diagonally disposed, the flaps can be disposed on the same side.

Figure 12:
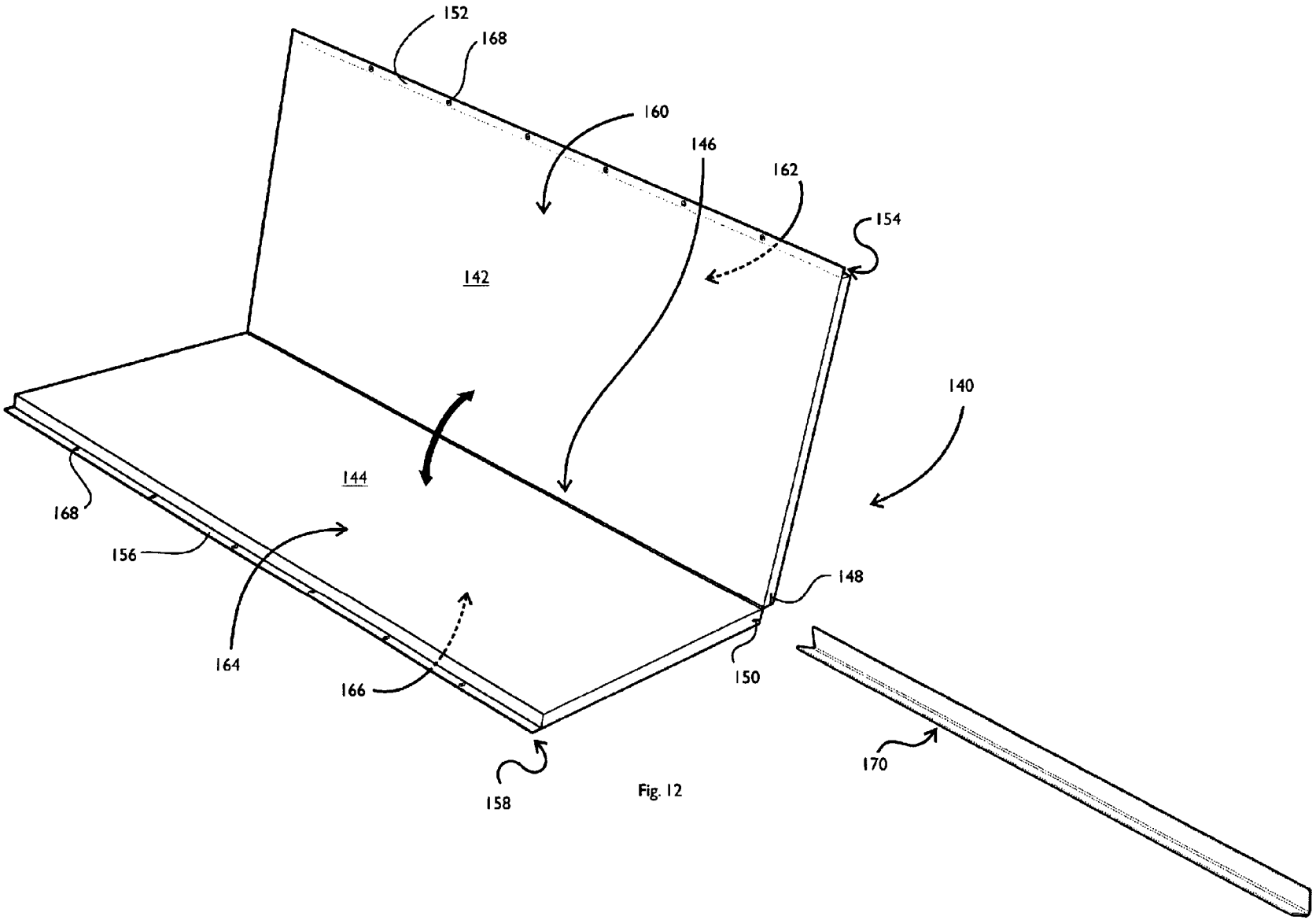
FIG. 12 shows a perspective view of another embodiment of a drywall apparatus, according to the principles of the present invention.

FIG. 12 shows a drywall apparatus 140 that can be used for an inner corner, an outer corner, a ceiling or a wall. The drywall apparatus 140 includes a first drywall panel 142, a second drywall panel 144, and a pliable hinge 146 connecting the first drywall panel 142 to the second drywall panel 144. The first drywall panel 142 includes a groove 148 near the hinge 146. Similarly, the second drywall panel 144 includes a groove 150 near the hinge 146.

A first flap 152 extends from an edge 154 of the first drywall panel 142. The first flap 152 is designed to overlap an adjacent drywall panel (not shown) abutted against the edge 154 of the first drywall panel 142 during a construction process, as described above with reference to FIGS. 8-11.

A second flap 156 extends from an opposite edge 158 of the second drywall panel 144. The second flap 156 is designed to overlap another adjacent drywall panel (not shown) abutted against the opposite edge 158 of the second drywall panel 144 during a construction process, as described above with reference to FIGS. 8-11.

The first drywall panel 142 has a front surface 160 and a back surface 162. The first flap 152 extends from the front surface 160 of the first drywall panel 142. The second drywall panel 144 has a front surface 164 and a back surface 166. The second flap 156 extends from the back surface 166 of the second drywall panel 144. Thus, if the first and second panels 142, 144 were coplanar, the flaps 152, 156 would be diagonally opposed. This geometry of flaps is similar to the geometry of FIG. 8, with the same attendant advantages. Other geometries are also possible where only one flap is present, in the front or in the back. Alternatively, two flaps at the front, or alternatively, two flaps at the back are possible. Also possible would be more than two flaps at side edges. For example, three or four flaps are also possible. Instead, or in addition, flaps can also be disposed on the top or bottom edges, which would be convenient if panels have to be abutted one on top of the other.

Holes 168 can be used to insert nails or other fasteners therethrough to affix the panels to studs, or other supporting members. For forming outer corners, a corner member 170 is inserted into the grooves 148, 150, as described above.

The front sides 160, 164 and/or the back sides 162, 166 can be designed to be exposed sides, which can be painted, wallpapered, plastered, etc. The side meant to be exposed, for example, can be covered with drywall finishing paper that can accept paint.

The embodiments described above are exemplary only and are not meant to limit the scope of the invention. From the description and drawings herein, other embodiments will be apparent to those of ordinary skill in the art and will be understood by them to lie within the scope of the invention defined by the claims below. For example, the first and second drywall panels, joined together by a hinge, can have tapered areas, forming "coves" or depressions, not only at the distal ends, such as areas 64*e*, but at the opposite ends near the hinge area. Such tapered ends would be useful for blending if drywall mud is used in the hinge area. In addition, the drywall panel can be manufactured to have various dimensions, as desired and appropriate.

What is claimed is:

1. A drywall apparatus for constructing planar partitions and corners comprising:

a first drywall panel having drywall paper on a surface thereof;

a second drywall panel;

a pliable hinge connecting the first drywall panel to the second drywall panel;

a first flap extending from an edge of the first drywall panel, the first flap formed by extending the drywall paper past the edge and being designed to overlap an adjacent drywall panel abutted against the edge of the first drywall panel during a construction process; and pre-formed holes in the first flap for inserting at least one of screws and nails to secure the drywall panel to a support surface, wherein the hinge allows the first drywall panel and the second drywall panel to assume a range of angles therebetween to thereby enable the apparatus to be used for constructing planar partitions and corners.

2. The drywall apparatus of claim 1, wherein the first drywall panel and the second drywall panel have surfaces laminated with drywall paper, the hinge being formed therefrom.

3. The drywall apparatus of claim 1, wherein each of the first and second drywall panels has a front surface and a back surface that include tapering edge surfaces adjacent distal ends of the first and second drywall panels to facilitate blending of the distal ends with adjacently positioned drywall sections positioned abuttingly against each of the distal ends when mudding during a construction process.

4. The drywall apparatus of claim 1, further comprising a second flap extending from an opposite edge of the second drywall panel, wherein the second flap is designed to overlap another adjacent drywall panel abutted against the opposite edge of the second drywall panel during a construction process.

5. The drywall apparatus of claim 1, further comprising a first groove in the first drywall panel adjacent and substantially parallel to the hinge;

a second groove in the second drywall panel adjacent and substantially parallel to the hinge; and a corner member for inserting into the first and second grooves to facilitate forming an outer corner.

6. A drywall apparatus comprising:

a drywall panel having drywall paper on a surface thereof; and a flap formed by extending the drywall paper from an edge of the drywall panel, wherein a) the flap is designed to overlap a surface of an adjacent drywall panel abutted against the edge of the drywall panel and b) the flap includes pre-formed holes for inserting fasteners to secure the drywall panel to a support surface.

7. The drywall apparatus of claim 6, further comprising another flap extending from an opposite edge of the drywall panel, wherein the other flap is designed to overlap a surface of another adjacent drywall panel abutted against the opposite edge of the drywall panel.

8. The drywall apparatus of claim 7, wherein the drywall panel has a front surface and a back surface, the flap extending from the front surface of the drywall panel, and the other flap extending from the back surface of the drywall panel, the flap being designed to overlap a front surface of the adjacent drywall panel abutted against the edge of the drywall panel and the other flap being designed to overlap a back surface of the other adjacent drywall panel abutted against the opposite edge of the drywall panel.

9. The drywall apparatus of claim 8, further comprising front drywall paper on the front surface;

back drywall paper on the back surface, wherein the first flap is formed by extending the front drywall paper and the second flap is formed by extending the back drywall paper.

10. The drywall apparatus of claim 7, wherein the drywall panel has a front surface, the flap extending from the front surface of the drywall panel, and the other flap extending from the front surface of the drywall panel, the flap being designed to overlap a front surface of the adjacent drywall panel abutted against the edge of the drywall panel and the other flap being designed to overlap a front surface of the other adjacent drywall panel abutted against the opposite edge of the drywall panel.

11. The drywall apparatus of claim 7, wherein the drywall panel has a back surface, the flap extending from the back surface of the drywall panel, and the other flap extending from the back surface of the drywall panel, the flap being designed to overlap a back surface of the adjacent drywall panel abutted against the edge of the drywall panel and the other flap being designed to overlap a back surface of the other adjacent drywall panel abutted against the opposite edge of the drywall panel.

12. A method of constructing planar partitions and corners, the method comprising:

providing a first drywall apparatus having a first pair of drywall panels connected together by a pliable hinge, each of the first pair having a front face;

for forming a corner in a corner region, placing the first drywall apparatus in the corner region so that the angle between the front faces of the first pair of drywall panels is different from 180 degrees; and providing a second drywall apparatus having a second pair of drywall panels connected together by a pliable hinge, each of the second pair having a front face, at least one of the first pair and the second pair of drywall panels having a flap extending from an edge thereof, the flap having pre-formed holes thereon;

for forming a planar partition in a wall or ceiling region, placing the second drywall apparatus in the wall or ceiling region so that the angle between the front faces of the second pair of drywall panels is substantially equal to 180 degrees, and so that the flap overlaps an edge of the other of the first pair and second pair; and inserting at least one of screws and nails through the pre-formed holes to fasten into a support structure.

* * * * *